US007489295B2

(12) United States Patent
Honbo

(10) Patent No.: US 7,489,295 B2
(45) Date of Patent: Feb. 10, 2009

(54) LIQUID CRYSTAL DISPLAY DEVICE, AND LIGHT SOURCE DRIVING CIRCUIT AND METHOD TO BE USED IN SAME

(75) Inventor: Nobuaki Honbo, Kawasaki (JP)

(73) Assignee: NEC LCD Technologies, Ltd., Kawasaki-Shi (JP)

( * ) Notice: Subject to any disclaimer, the term of this patent is extended or adjusted under 35 U.S.C. 154(b) by 828 days.

(21) Appl. No.: 11/118,432

(22) Filed: May 2, 2005

(65) Prior Publication Data

US 2005/0242756 A1 Nov. 3, 2005

(30) Foreign Application Priority Data

Apr. 30, 2004 (JP) ..... 2004-136331

(51) Int. Cl.
*G09G 3/36* (2006.01)

(52) U.S. Cl. ..... 345/102; 345/213; 345/87

(58) Field of Classification Search ..... 345/102, 345/103, 104, 87, 213; 315/5.43
See application file for complete search history.

(56) References Cited

U.S. PATENT DOCUMENTS 5,940,061 A * 8/1999 Sato ..... 345/213
7,362,303 B2 * 4/2008 Jang ..... 345/102
2004/0051692 A1 * 3/2004 Hirakata et al. ..... 345/102

FOREIGN PATENT DOCUMENTS

JP 5-113766 5/1993
JP 2002-8887 1/2002

* cited by examiner

*Primary Examiner*—Kevin M Nguyen
(74) *Attorney, Agent, or Firm*—Young & Thompson

(57) ABSTRACT

A liquid crystal display device is provided which is capable of preventing flicker or fringes in a display screen occurring even when changes in frequencies of a vertical sync signal and horizontal sync signal contained in a video signal input to the liquid crystal display device occur. A frequency detecting circuit sets a frequency of a driving pulse voltage at a value in the vicinity of "positive integer+½" times of the frequency of the horizontal sync signal and a pulse frequency for PWM (Pulse Width Modulation) light control at a value in the vicinity of a positive integral multiple or "positive integer+½" times of the vertical sync signal and a resonant frequency at a value in the vicinity of the frequency of the driving pulse voltage by adjusting capacitance value of a resonant capacitor.

14 Claims, 13 Drawing Sheets

LIQUID CRYSTAL DISPLAY DEVICE, AND LIGHT SOURCE DRIVING CIRCUIT AND METHOD TO BE USED IN SAME

BACKGROUND OF THE INVENTION

1. Field of the Invention

The present invention relates to a liquid crystal display device, and a light source driving circuit and method to be used in the liquid crystal display device, and more particularly to the liquid crystal display device having a function, such as a multi-sync function, of operating in a case when frequencies of a vertical sync signal and horizontal sync signal contained in a video input signal are changed whenever necessary, and the light source driving circuit and the light source driving method to be respectively used in the liquid crystal display device.

The present application claims priority of Japanese Patent Application No. 2004-136331 filed on Apr. 30, 2004, which is hereby incorporated by reference.

2. Description of the Related Art

In a liquid crystal display device, as a light source (for example, a backlight) to illuminate a liquid crystal panel, a discharge lamp such as a cold cathode tube is used in many cases. The discharge lamp is lit when a high-voltage alternating current is fed. The high-voltage alternating current is produced by a resonant circuit made up of an inductor of a transformer in an inverter and a capacitor, and efficiency of the resonant circuit differs depending on a frequency of the high-voltage alternating current. Higher efficiency is obtained when the resonant circuit operates in the vicinity of a resonant frequency. Recently, the liquid crystal display device is widely used in personal computers, televisions, or a like, as a screen displaying means and has a function, such as a multi-sync function, of operating in a manner to correspond to a vertical sync signal and horizontal sync signal with various frequencies. However, the conventional liquid crystal display device has a problem in that, in the case when a driving frequency of a discharge lamp is fixed at a resonant frequency that enables the resonant circuit to operate in an efficient manner, when frequencies of a vertical sync signal and horizontal sync signal contained in a video input signal are changed, flicker and/or fringes caused by interference with the driving frequency of the discharge lamp are visually recognized on a display screen of the liquid crystal display device. To solve this problem, conventional technologies are proposed.

For example, a backlight driving circuit is disclosed in Japanese Patent Application Laid-open No. 2002-8887 in which an oscillation circuit 1 has, as shown in FIG. 15, an LC resonant circuit made up of an inductance device and a capacitance device, and operates at a resonant frequency of the LC resonant circuit. Then, a driving signal having a resonant frequency of the LC resonant circuit is fed from the oscillation circuit 1 to a backlight 2. Moreover, a horizontal frequency of an input video signal "in" is detected by a microcomputer 3 and an oscillation frequency of the oscillation circuit 1 is calibrated according to the horizontal frequency. That is, if the detected horizontal frequency is at a specified threshold value or less, capacitance or inductance of the above LC resonant circuit is switched so that the oscillation frequency exceeds the threshold value. Also, if the detected horizontal frequency is at a specified threshold value or more, the capacitance or inductance of the LC resonant circuit is switched so that an oscillation frequency becomes the threshold value or less and, as a result, the horizontal frequency is switched, however, flicker and fringes caused by the interference with a driving frequency of the backlight 2 are not readily visually recognized on a display screen of a liquid crystal display device.

Also, a liquid crystal display device provided with a backlight is disclosed in Japanese Patent Application Laid-open No. Hei 05-113766 which includes, as shown in FIG. 16, an F-V (Frequency-Voltage) converter 11, a voltage controlling circuit 12, an oscillation circuit 13, a boosting transformer 14, and a fluorescent lamp (used as the backlight) 15. In the liquid crystal display device, a frequency of a horizontal sync signal "c" contained in a video signal is detected by the F-V converter 11 and an oscillation frequency of the oscillation circuit 13 is made by the voltage controlling circuit 12 to be variable according to the detected frequency and a lighting frequency of the fluorescent lamp 15 through the boosting transformer 14 is changed. As a result, a flicker caused by interference between a driving frequency for the liquid crystal display device and a lighting frequency of the fluorescent lamp (backlight) 15 disappears from a display screen. Additionally, even if the lighting frequency is changed, a power source voltage is made variable so that luminance of the fluorescent lamp 15 becomes constant.

However, the above conventional technologies have the following problems. That is, in the backlight driving circuit disclosed in the Japanese Patent Application Laid-open No. 2002-8887, when a resonant frequency on the transformer's primary side of the LC resonant circuit making up the oscillation circuit 1 is changed, the changed resonant frequency does not coincide with a frequency on the transformer's secondary side, which causes a problem in that efficiency of the LC resonant circuit is degraded.

Moreover, in the liquid crystal display device with the backlight disclosed in the Japanese Patent Application Laid-open No. Hei 05-113766, a lighting frequency of the fluorescent lamp 15 as backlight is changed based on the horizontal sync signal "c", whereas the flicker caused by interference between the driving frequency of the liquid crystal display device and the lighting frequency of the fluorescent lamp 15 occurs not only due to interference between the lighting frequency of the fluorescent lamp 15 and the horizontal sync signal "c" used in the liquid crystal display device, but due to interference between the lighting frequency of the fluorescent lamp 15 and the vertical sync signal used in the liquid crystal display device. Therefore, even if only the horizontal sync signal "c" is detected, ripples are visually recognized in some cases. Also, there is a problem in that the efficiency of the oscillation circuit 13 is degraded due to the change in the lighting frequency of the fluorescent lamp 15.

SUMMARY OF THE INVENTION

In view of the above, it is an object of the present invention to provide a liquid crystal display device which is capable of preventing flicker or fringes in a display screen occurring when frequencies of a vertical sync signal and horizontal sync signal contained in a video signal input to the liquid crystal display device are changed.

According to a first aspect of the present invention, there is provided a liquid crystal display device including:

a liquid crystal panel to display an image according to a video input signal;

a light source to illuminate the liquid crystal panel when a driving pulse voltage is applied; and a light source driving circuit having a resonant circuit containing stray capacitance that the light source has and a resonant capacitor to exercise PWM (pulse width modulation) light control by applying the driving pulse voltage whose frequency is set at a value in a vicinity of a resonant frequency of the resonant circuit intermittently to the light source at a pulse frequency and at a duty ratio set respectively for the PWM light control; and wherein the light source driving circuit includes a driving pulse setting unit to detect a frequency of a horizontal sync signal and a frequency of a vertical sync signal contained in the video input signal, to set/change the frequency of the driving pulse voltage and the resonant frequency of the resonant circuit in a manner to correspond to a change in the frequency of the horizontal sync signal, and to set/change the pulse frequency for the PWM control in a manner to correspond to a change in the frequency of the vertical sync signal.

In the foregoing, a preferable mode is one wherein the driving pulse setting unit sets the frequency of the driving pulse voltage at a value at which flicker and fringes caused by interference between the horizontal sync signal and the driving pulse voltage are not visually recognized on the liquid crystal panel and sets the resonant frequency at a value in a vicinity of the frequency of the driving pulse voltage, and sets the pulse frequency for the PWM light control at a value at which the flicker and the fringes caused by interference between the vertical sync signal and a frequency pulse for the PWM light control are not visually recognized on the liquid crystal panel.

Also, a preferable mode is one wherein the driving pulse setting unit sets the frequency of the driving pulse voltage at a value in a vicinity of "M+½" times ("M": a positive integer) of the frequency of the horizontal sync signal, the pulse frequency for the PWM light control at a value in a vicinity of "N" times or "N+½" times ("N": a positive integer) of the frequency of the vertical sync signal, and the resonant frequency at a value in a vicinity of the frequency of the driving pulse voltage by adjusting capacitance value of the resonant capacitor.

Also, a preferable mode is one wherein the driving pulse setting unit sets the frequency of the driving pulse voltage at a value in a vicinity of "M" times ("M": a positive integer) of the frequency of the horizontal sync signal, the pulse frequency for the PWM light control at a value in a vicinity of "N" times or "N+½" times ("N": a positive integer) of the frequency of the vertical sync signal, and the resonant frequency at a value in a vicinity of the frequency of the driving pulse voltage by adjusting capacitance value of the resonant capacitor.

Also, a preferable mode is one wherein the driving pulse setting unit sets the frequency of the driving pulse voltage at a value in a vicinity of "M+½" times ("M": a positive integer) of the frequency of the horizontal sync signal, the pulse frequency for the PWM light control at a value in a vicinity of "N" times or "N+½" times ("N": a positive integer) of the frequency of the vertical sync signal, and the resonant frequency at a value in a vicinity of the frequency of the driving pulse voltage by adjusting capacitance value of the stray capacitance.

Also, a preferable mode is one wherein the driving pulse setting unit sets the frequency of the driving pulse voltage at a value in a vicinity of "M" times ("M": a positive integer) of the frequency of the horizontal sync signal and the pulse frequency for the PWM light control at a value in a vicinity of "N" times or "N+½" times ("N": a positive integer) of the frequency of the vertical sync signal and the resonant frequency at a value in a vicinity of the frequency of the driving pulse voltage by adjusting capacitance value of the stray capacitance.

According to a second aspect of the present invention, there is provided a light source driving circuit being used for a liquid crystal display device having a liquid crystal panel to display an image according to a video input signal and a light source to illuminate the liquid crystal panel when a driving pulse voltage is applied, and including a resonant circuit containing stray capacitance that the light source has and a resonant capacitor to exercise PWM (pulse width modulation) light control by applying the driving pulse voltage whose frequency is set at a value in a vicinity of a resonant frequency of the resonant circuit intermittently to the light source at a pulse frequency and at a duty ratio set respectively for the PWM light control, the light source driving circuit further including:

a driving pulse setting unit to detect a frequency of a horizontal sync signal and a frequency of a vertical sync signal contained in the video input signal, to set/change the frequency of the driving pulse voltage and the resonant frequency of the resonant circuit in a manner to correspond to a change in the frequency of the horizontal sync signal, and to set/change the pulse frequency for the PWM control in a manner to correspond to a change in the frequency of the vertical sync signal.

According to a third aspect of the present invention, there is provided a light source driving method being used for a liquid crystal display device having a liquid crystal panel to display an image according to a video input signal and a light source to illuminate the liquid crystal panel when a driving pulse voltage is applied, and including: using a resonant circuit containing stray capacitance that the light source has and a resonant capacitor, and exercising PWM (pulse width modulation) light control by applying the driving pulse voltage whose frequency is set at a value in a vicinity of a resonant frequency of the resonant circuit intermittently to the light source at a pulse frequency and at a duty ratio set respectively for the PWM light control, the light source driving method further including:

detecting a frequency of a horizontal sync signal and a frequency of a vertical sync signal contained in the video input signal, setting/changing the frequency of the driving pulse voltage and the resonant frequency of the resonant circuit in a manner to correspond to a change in the frequency of the horizontal sync signal, and setting/changing the pulse frequency for the PWM control in a manner to correspond to a change in the frequency of the vertical sync signal.

With the above configuration, the driving pulse setting unit detects frequencies of both the horizontal sync signal and the vertical sync signal contained in the video input signal, changes the frequency of the driving pulse voltage for setting in a manner to correspond to a change in the horizontal sync signal, also changes the resonant frequency of the resonant circuit for setting, and changes the pulse frequency for the PWM light control in a manner to correspond to a change in the frequency of the vertical sync signal and, therefore, even when changes in the frequencies of the horizontal sync signal and the vertical sync signal occur, visual seeing of flicker and ripples caused by interference between the driving pulse voltage and the horizontal sync signal on the liquid crystal panel can be suppressed and degradation in the efficiency of the light source can be prevented.

Also, the driving pulse setting unit sets the frequency of the driving pulse voltage at a value in the vicinity of "M+½" ("M": a positive integer) times of the frequency of the horizontal sync signal and a pulse frequency for the PWM light control at a value in the vicinity of "N" times or "N+½" times ("N": a positive integer) of the frequency of the vertical sync signal and a resonant frequency at a value in the vicinity of the driving pulse voltage by adjusting capacitance value of the resonant capacitor and, therefore, even when changes in the frequencies of the horizontal sync signal and the vertical sync signal occur, visual seeing of flicker and ripples caused by interference between the driving pulse voltage and the horizontal sync signal on the liquid crystal panel can be suppressed and degradation in the efficiency of the light source can be prevented. Moreover, even when the driving pulse setting unit sets the frequency of the driving pulse voltage at a value in the vicinity of "M" times ("M": a positive integer) of the frequency of the horizontal sync signal, the same effect as above can be obtained.

Moreover, the driving pulse setting unit sets the frequency of the driving pulse voltage at a value in the vicinity of "M+½" times ("M": a positive integer) of the frequency of the horizontal sync signal and a pulse frequency for the PWM light control at a value in the vicinity of "N" times or "N+½" times ("N": a positive integer) of the frequency of the vertical sync signal and a resonant frequency at a value in the vicinity of the driving pulse voltage by adjusting capacitance value of the stray capacitance and, therefore, even when changes in the frequencies of the horizontal sync signal and the vertical sync signal occur, visual seeing of flicker and ripples caused by interference between the driving pulse voltage and the horizontal sync signal on the liquid crystal panel can be suppressed and degradation in the efficiency of the light source can be prevented. Moreover, even when the driving pulse setting unit sets the frequency of the driving pulse voltage at a value in the vicinity of "M" times ("M": a positive integer) of the frequency of the horizontal sync signal, the same effect as above can be obtained.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENT

Best modes of carrying out the present invention will be described in further detail using various embodiments with reference to the accompanying drawings. A liquid crystal display device is provided in which frequencies of a horizontal sync signal and vertical sync signal contained in a video input signal are detected, a frequency of a driving pulse voltage to be fed to a light source is set at a value at which flicker and fringes caused by interference between the horizontal sync signal and the frequency of a driving pulse voltage are not visually recognized on the liquid crystal panel, and a pulse frequency for PWM (Pulse Width Modulation) light control to be fed to the light source is set at a value at which the flicker and fringes caused by interference between the vertical sync signal and the frequency pulse for the PWM light control are not visually recognized on the liquid crystal panel and a resonant frequency of a resonant circuit is set at a value in the vicinity of the frequency of the driving pulse voltage.

First Embodiment

Figure 1:
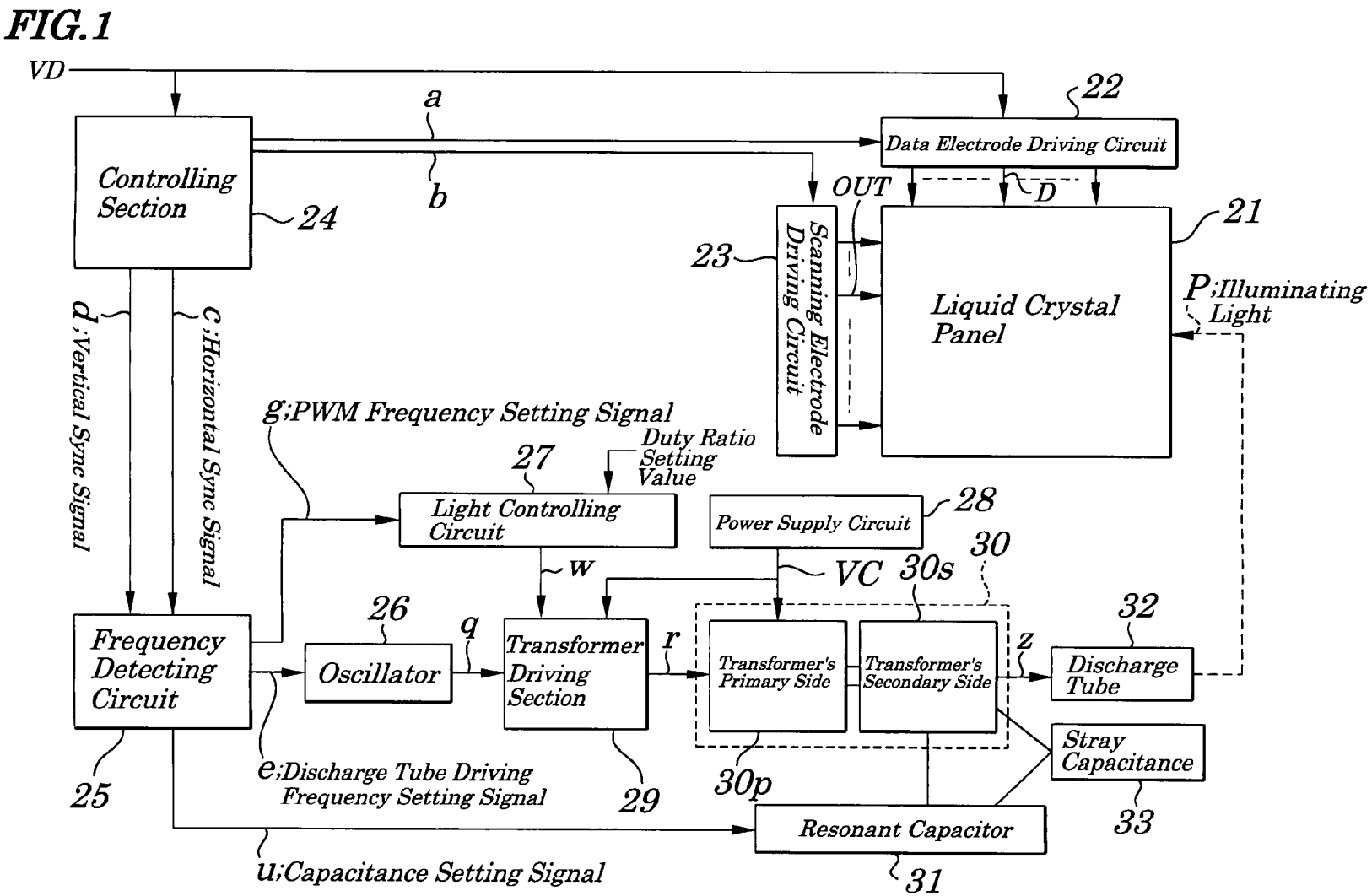
FIG. 1 is a schematic block diagram showing electrical configurations of a liquid crystal display device according to a first embodiment of the present invention.

FIG. 1 is a schematic block diagram showing electrical configurations of a liquid crystal display device of a first embodiment of the present invention. The liquid crystal display device of the first embodiment includes a liquid crystal panel 21, a data electrode driving circuit 22, a scanning electrode driving circuit 23, a controlling section 24, a frequency detecting circuit 25, an oscillator 26, a light controlling circuit (dimmer circuit) 27, a power supply circuit 28, a transformer driving section 29, a transformer 30, a resonant capacitor 31, a discharge tube 32, and a stray capacitance 33. In the liquid crystal panel 21, scanning signals "OUT" are sequentially applied to a scanning electrode (not shown) and corresponding pixel data "D" are applied to a data electrode (not shown) and, as a result, corresponding pixel data "D" are applied to corresponding liquid crystal cells (not shown) and modulation is performed on an illuminating light "P" fed from the discharge tube 32 in a manner to correspond to a display image. The data electrode driving circuit 22 applies a voltage corresponding to pixel data "D", according to a video input signal "VD", to each data electrode (not shown) of the liquid crystal panel 21. The scanning electrode driving circuit 23 applies scanning signals "OUT" to each scanning electrode (not shown) of the liquid crystal panel 21 in a one-pass scanning manner. The controlling section 24 transmits a control signal "a" to the data electrode driving circuit 22 according to the video input signal "VD" and a control signal "b" to the scanning electrode driving circuit 23. Also, the controlling section 24 transmits a horizontal sync signal "c" and vertical sync signal "d" contained in the video input signal "VD" to the frequency detecting circuit 25.

The oscillator 26 is made up of, for example, a VCO (Voltage Controlled Oscillator) (not shown) and produces an output signal "q" with a frequency according to a discharge tube driving frequency setting signal "e" fed from the frequency detecting circuit 25. The light controlling circuit 27 produces a control signal "w" having a duty ratio that has been set according to a frequency and duty ratio setting value determined according to a PWM (Pulse Width Modulation) frequency setting signal "g" fed from the frequency detecting circuit 25 and exercises PWM light control. The power supply circuit 28 feeds a power source "VC" to the transformer driving section 29 and a primary side 30*p* of the transformer 30. The power source "VC" is fed to the transformer driving section 29, which produces an output signal "r" to drive the transformer 30 using the signal "q" output from the oscillator 26 according to the control signal "w" fed from the light controlling circuit 27 and outputs the output signal "r" on the primary side 30*p* of the transformer 30. The power source "VC" is fed on the primary side 30*p* of the transformer 30. The primary side 30*p* and a secondary side 30*s* of the transformer 30, the stray capacitance 33, and the resonant capacitor 31 make up a resonant circuit. The resonant circuit resonates in combination with the primary side 30*p* and the secondary side 30*s* of the transformer 30, the stray capacitance 33, and the resonant capacitor 31, and produces a driving pulse voltage "z". The resonant capacitor 31 is a variable capacitor that can change its capacitance value in response to a capacitance setting signal "u" fed from the frequency detecting circuit 25. The discharge tube 32 is made up of, for example, a cold cathode tube (not shown) or a like and emits light when a driving pulse voltage "z" is applied thereto and applies illuminating light "P" to the liquid crystal panel 21 through a light guiding plate (not shown) or a like. The stray capacitance 33 is formed between wirings to connect the secondary side 30*s* of the transformer 30 and the discharge tube 32. In addition, when the discharge tube 32 is lit and the conductive plasma occurs in the discharge tube 32, an electrostatic capacitance between the plasma and a conductive reflecting mirror (not shown) is produced, which increases capacitance value of the stray capacitance 33.

The frequency detecting circuit 25 detects frequencies of both the horizontal sync signal "c" and the vertical sync signal "d" and produces a discharge tube driving frequency setting signal "e" corresponding to the frequency of the horizontal sync signal "c" to transmit the produced discharge tube driving frequency setting signal "e" to the oscillator 26 and produces a capacitance setting signal "u" to transmit the produced capacitance setting signal "u" to the resonant capacitor 31 and also produces a PWM frequency setting signal "g" corresponding to the frequency of the vertical sync signal "d" to transmit the produced vertical sync signal "d" to the light controlling circuit 27. In the frequency detecting circuit 25 of the embodiment, a frequency of the driving pulse voltage "z" is set at a value at which flicker and fringes caused by interference between the horizontal sync signal "c" and driving pulse voltage "z" are not visually recognized on the liquid crystal panel 21 and a resonant frequency of the resonant circuit is set at a value in the vicinity of the frequency of the driving pulse voltage "z" and a pulse frequency for PWM light control is set at which flicker and fringes caused by interference between the vertical sync signal "d" and the pulse frequency for PWM light control are not visually recognized on the liquid crystal panel 21.

For example, the frequency detecting circuit 25 sets a frequency of the driving pulse voltage "z" at a value in the vicinity of "M+½" times ("M": a positive integer) of a frequency of the horizontal sync signal "c" and the pulse frequency for the above PWM light control at a value in the vicinity of "N" times or "N+½" times ("N": a positive integer) of the vertical sync signal "d" and a resonant frequency at a value in the vicinity of the driving pulse voltage "z" by adjusting (calibrating) capacitance value of the resonant capacitor 31. Alternatively, the frequency detecting circuit 25 sets a frequency of the driving pulse voltage "z" at a value in the vicinity of "M" times ("M": a positive integer) of the frequency of the horizontal sync signal "c" and the pulse frequency for the above PWM light control at a value in the vicinity of "N" times or "N+½" times ("N": a positive integer) of the frequency of the vertical sync signal "d" and the above resonant frequency at a value in the vicinity of the driving pulse voltage "z" by adjusting capacitance value of the resonant capacitor 31.

Figure 2:
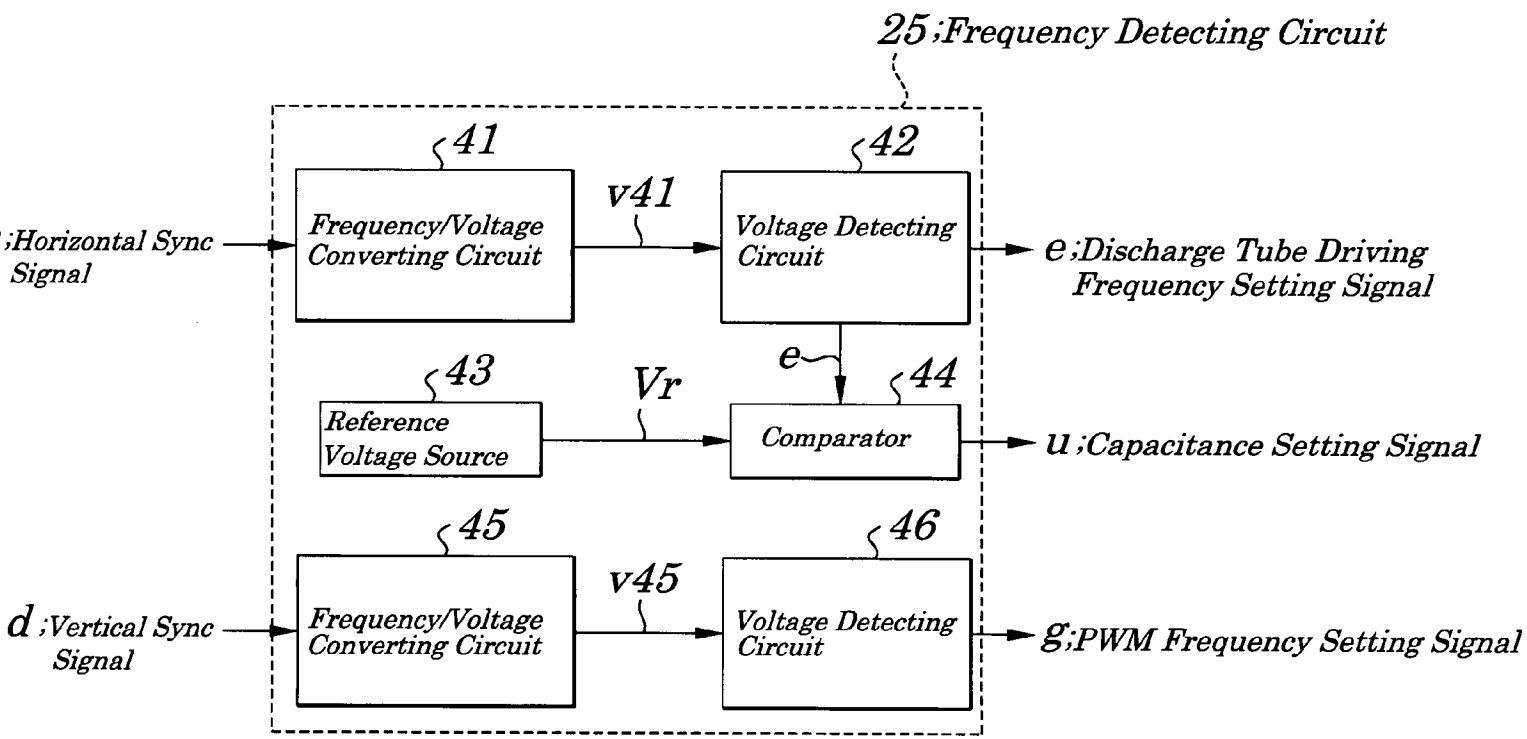
FIG. 2 is a schematic block diagram showing electrical configurations of a frequency detecting circuit employed in the liquid crystal display device of FIG. 1.

FIG. 2 is a schematic block diagram showing electrical configurations of the frequency detecting circuit 25 employed in the liquid crystal display device of FIG. 1. The frequency detecting circuit 25, as shown in FIG. 2, includes a frequency/voltage converting circuit 41, a voltage detecting circuit 42, a reference voltage source 43, a comparator 44, a frequency/voltage converting circuit 45, and a voltage detecting circuit 46. The frequency/voltage converting circuit 41 is made up of an F-V (Frequency-Voltage) converter (not shown) and converts a frequency of the horizontal sync signal "c" into a voltage "v41". The voltage detecting circuit 42 is made up of, for example, an LUT (Look Up Table) or a like and produces the discharge tube driving frequency setting signal "e" at a level corresponding to the voltage "v41". The reference voltage source 43 produces a reference voltage "Vr" used to generate a capacitance setting signal "u". The comparator 44 compares to check whether the discharge tube driving frequency setting signal "e" is larger or smaller than the reference voltage "Vr" and produces the capacitance setting signal "u". The frequency/voltage converting circuit 45 is made up of an F-V (Frequency-Voltage) converter and converts a frequency of the vertical sync signal "d" into the voltage "v45". The voltage detecting circuit 46 is made up of, for example, an LUT or a like and produces the PWM frequency setting signal "g" at a level corresponding to the voltage "v45".

Figure 3:
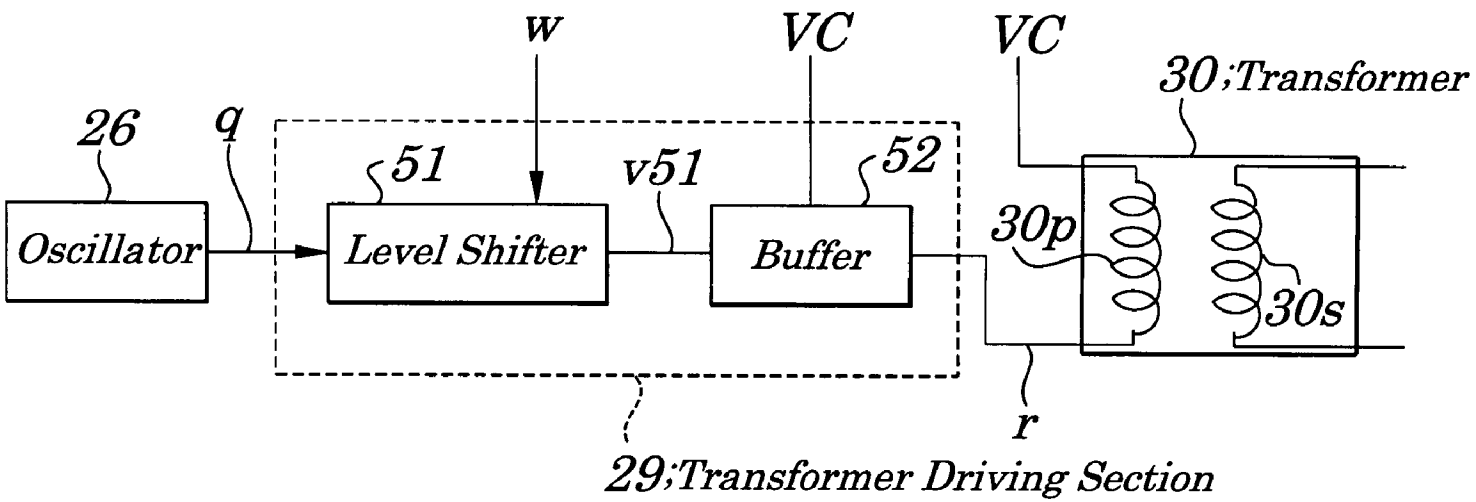
FIG. 3 is a schematic block diagram showing an oscillator, transformer driving section and transformer, which is the diagram extracted from FIG. 1.

FIG. 3 is a diagram showing the oscillator 26, the transformer driving section 29 and the transformer 30 which are extracted from FIG. 1 in which electrical configurations of the transformer driving section 29 are shown in particular. The transformer driving section 29, as shown in FIG. 3, is made up of a level shifter 51 and a buffer 52. The level shifter 51 converts the output signal "q" output from the oscillator 26 into a level that causes the transformer 30 to be driven and produces an output signal "v51" intermittently at a frequency and a duty ratio obtained according to the control signal "w" fed from the light controlling circuit 27 (FIG. 1). The buffer 52 inputs the output signal "v51" at high input impedance and transmits the output signal "r" at low output impedance on the primary side 30*p* of the transformer 30.

Figure 4:
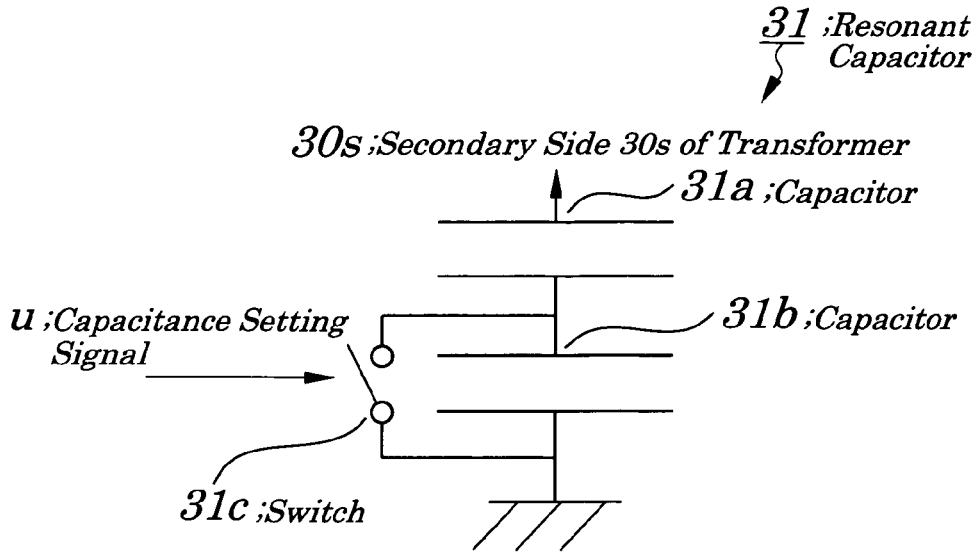
FIG. 4 is a schematic block diagram showing electrical configurations of a resonant capacitor of FIG. 1.

FIG. 4 is a schematic block diagram showing electrical configurations of the resonant capacitor 31 of FIG. 1. The resonant capacitor 31, as shown in FIG. 4, is made up of capacitors 31*a* and 31*b*, and a switch 31*c*, and is connected in parallel to the secondary side 30*s* of the transformer 30. The capacitor 31*a* is connected in series to the capacitor 31*b*. The switch 31*c* is connected to the capacitor in parallel and is turned ON/OFF according to the capacitance setting signal "u".

Figure 5:
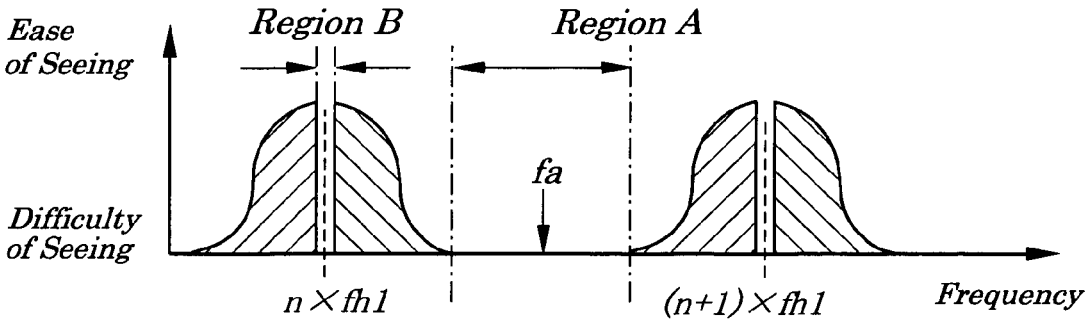
FIG. 5 is a diagram showing easiness of seeing of flicker and fringes occurring when a frequency of a driving pulse voltage is changed.
Figure 6:
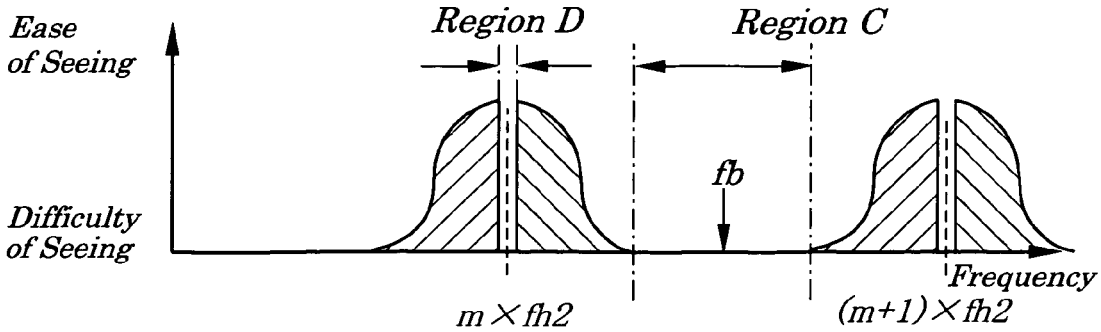
FIG. 6 is a diagram showing easiness of seeing interference fringes occurring when a frequency of a horizontal sync signal is set at "fh2"

FIG. 5 is a diagram showing easiness of seeing of flicker and fringes (ripples) caused by interference between the driving pulse voltage "z" and the horizontal sync signal "c" occurring when a frequency of the driving pulse voltage "z" is changed with a frequency of the horizontal sync signal "c" being set at "fh1" in which a frequency of the driving pulse voltage "z" is plotted as abscissa and easiness in seeing of ripples as ordinate. FIG. 6 is a diagram showing easiness of seeing fringes occurring when a frequency of the horizontal sync signal "c" is set at "fh2". A method for driving a light source employed in the liquid crystal display of the first embodiment is described by referring to FIGS. 5 and 6. As shown in FIG. 5, when the frequency of the driving pulse voltage "z" is in a region shown by hatch patterns, ripples are visually recognized on the liquid crystal panel 21. When a frequency of the horizontal sync signal "c" is slightly deviated from a value of a positive integral multiple "n" (n: a positive integer) of a frequency "fh1", the ripples are visually recognized most and no ripples are visually recognized in the region A and region B. For example, in the case of the liquid crystal panel 21 having a specification of XGA (extended Graphics Array, resolution being 1024 dots×768 dots), the frequency "fh1" is equal to about 46 kHz (=frame frequency 60 Hz×the number of pixels in vertical direction 768) and, when a frequency of the driving pulse voltage "z" is about 46 kHz±2 kHz, ripples are visually recognized most.

Also, when the specification of the liquid crystal panel 21 is switched from XGA to SXGA (Super extended Graphics Array, resolution being 1280 dots×1024 dots), the frequency "fh2" of the horizontal sync signal "c", as shown in FIG. 6, is equal to about 61 kHz (=frame frequency of 60 Hz×the number of pixels in vertical direction of 1024). In FIG. 6, as in the case of FIG. 5, when the frequency of the driving pulse voltage "z" is in a region shown by hatch patterns, ripples are visually recognized on the liquid crystal panel 21. When a frequency of the horizontal sync signal "c" is slightly deviated from a value of a positive integral multiple "m" ("m" is a positive integer) of a frequency "fh2", the ripples are visually recognized most and no ripples are visually recognized in the region C and region D. When a frequency of the driving pulse voltage "z" is about 61 kHz±2 kHz, ripples are visually recognized most (where, "m" is a positive integer).

In the method for driving the light source, frequencies of the horizontal sync signal "c" and the vertical sync signal "d" contained in the video input signal "VD" are detected by the frequency detecting circuit 25 and a frequency of the driving pulse voltage "z" is set at a changed value and a resonant frequency is set at a changed value in a manner to correspond to a change in the frequency of the horizontal sync signal "c" and the pulse frequency for the PWM light control PWM light control exercised by a light controlling circuit 27 is set at a changed value in a manner to correspond to a change in the frequency of the vertical sync signal "d".

That is, the frequency "fh1" of the horizontal sync signal "c" and the frequency "fv1" of the vertical sync signal "d" are detected by the frequency detecting circuit 25 and the discharge tube driving frequency setting signal "e" is transmitted from the frequency detecting circuit 25 to the oscillator 26 and the oscillator 26 oscillates to output the output signal "q" with a frequency "fa". The frequency "fa" may be any value so long as the frequency "fa" is within a range labeled in FIG. 5 as Region A, however, from viewpoints of easiness of setting frequencies and difficulty in seeing ripples, it is desirous that the frequency "fa" is in the vicinity of the frequency of "(n+½)×fh1". Also, the integral multiple of the frequency "fa" is set at a value in the vicinity of "(L+½)×fv1" or "L×fv1" (L: a positive integer) to avoid interference between the driving pulse voltage "z" and the vertical sync signal "d". The output signal "q" is level-shifted by the transformer driving section 29 and the output signal "r" is transmitted from the transformer driving section 29 to the primary side 30*p* of the transformer 30. When the output signal "r" is input to the primary side 30*p* of the transformer 30, a high-voltage alternating current (driving pulse voltage "z") is applied by a resonant circuit made up of the secondary side 30*s* of the transformer 30, the resonant capacitor 31, and the stray capacitance 33 from the secondary side 30*s* of the transformer 30 to the discharge tube 32 which is lit. At this time, the capacitance setting signal "u" is input from the frequency detecting circuit 25 to the resonant capacitor 31, and the switch 31*c* shown in FIG. 4 is in an OFF state.

In this case, capacitance C1 of the resonant capacitor 31 is in the vicinity of a value that satisfies a following equation:

$$fa=1/[2\pi\{L(C1+C2)\}^{1/2}]$$

where L denotes inductance of secondary side 30*s* of transformer 30 and C2 denotes capacitance value of the stray capacitance 33. Moreover, in a state in which the output signal "q" with a frequency "fa" has been output from the oscillator 26, the PWM frequency setting signal "g" is transmitted from the frequency detecting circuit 25 to the light controlling circuit 27 and the control signal "w" is transmitted from the light controlling circuit 27 to the transformer driving circuit 29 and PWM light control is exerted at a frequency in the vicinity of the set "(k1+½)×fv1" or "k1×fv1" (k1: a positive integer) and at a duty ratio.

Also, when a frequency "fh1" of the horizontal sync signal "c" is changed to be "fh2" and the frequency "fv1" of the vertical sync signal "d" is changed to be "fv2" due to switching of the specification of the liquid crystal panel 21 from VGA to SXGA for example, the changed frequencies are detected by the frequency detecting circuit 25 and the output signal "q" with a frequency of "fb" (fb>fa) is output from the oscillator 26. The frequency "fb" may be any frequency so long as the frequency is within a range labeled in FIG. 6 as region C, however, from the viewpoints of easiness of setting frequencies and difficulty of seeing ripples, it is desirous that the frequency is in the vicinity of the frequency of "(m+½)×fh2". Also, the integral multiple of the frequency "fb" is set at a value in the vicinity of "(L+½)×fv2" or "L×fv2" (L: a positive integer) to avoid interference between the driving pulse voltage "z" and vertical sync signal "d". Moreover, in this state, the PWM frequency setting signal "g" is transmitted from the frequency detecting circuit 25 to the light controlling circuit 27 and the control signal "w" is transmitted from the light controlling circuit 27 to the transformer driving circuit 29 and PWM light control is exerted at a frequency in the vicinity of the set "(k2+½)×fv2" or "k2×fv2" (k2: a positive integer) and at a duty ratio. In this case, the capacitance setting signal "u" is input from the frequency detecting circuit 25 to the resonant capacitor 31 and the switch 31*c* shown in FIG. 4 is put into an ON state. At this time, the capacitance C3 of the resonant capacitor 31 is in the vicinity of a value that satisfies a following equation:

$$fb=1/[2\pi\{L(C3+C2)\}^{1/2}]$$

Also, when a frequency of the driving pulse voltage "z" is set at an "n" (a positive integer) times of a frequency "fh1" of the horizontal sync signal "c" or at a value in its vicinity (for example, about "n×fh1±1 kHz"), the capacitance C1 of the resonant capacitor 31 is in the vicinity of a value that satisfies a following equation:

$$n \times fh1 = 1/[2\pi\{L(C1+C2)\}^{1/2}]$$

where L denotes an inductance value of the secondary side 30*s* of the transformer 30 and C2 denotes capacitance value of the stray capacitance 33.

Also, when a frequency "fh1" of the horizontal sync signal "c" is changed to be "fh2" and a frequency of the driving pulse voltage "z" is changed to be an "m" (a positive integer) times of the frequency fh2 or a value in its vicinity (for example, about "m×fh2±1 kHz") due to switching of the specification of the liquid crystal panel 21 from VGA to, for example, SXGA, the capacitance C3 of the resonant capacitor 31 is in the vicinity of a value that satisfies a following equation:

$$m \times fh2 = 1/[2\pi\{L(C3+C2)\}^{1/2}]$$

As described above, in the first embodiment, the frequency detecting circuit 25 sets the frequency of the driving pulse voltage "z" at a value in the vicinity of "M+½" times ("M": a positive integer) of the frequency of the horizontal sync signal "c", the pulse frequency for the PWM light control at a value in the vicinity of "N" times or "N+½" times ("N": a positive integer) of the frequency of the vertical sync signal "d" and the resonant frequency at a value in the vicinity of a frequency of the driving pulse voltage "z" by adjusting capacitance value of the resonant capacitor 31 and, therefore, even if a change occurs in a frequencies of the horizontal sync signal "c" and vertical sync signal "d", visual seeing of flicker and ripples caused by reference between the driving pulse voltage "z" of the discharge tube 32 and the horizontal sync signal "c" on the liquid crystal panel 21 can be suppressed and degradation in efficiency of the discharge tube 32 can be prevented. Moreover, even when the frequency detecting circuit 25 sets a frequency of the driving pulse voltage "z" at a value in the vicinity of a positive integral multiple of a frequency of the horizontal sync signal "c", the same advantages as above can be obtained.

Second Embodiment

Figure 7:
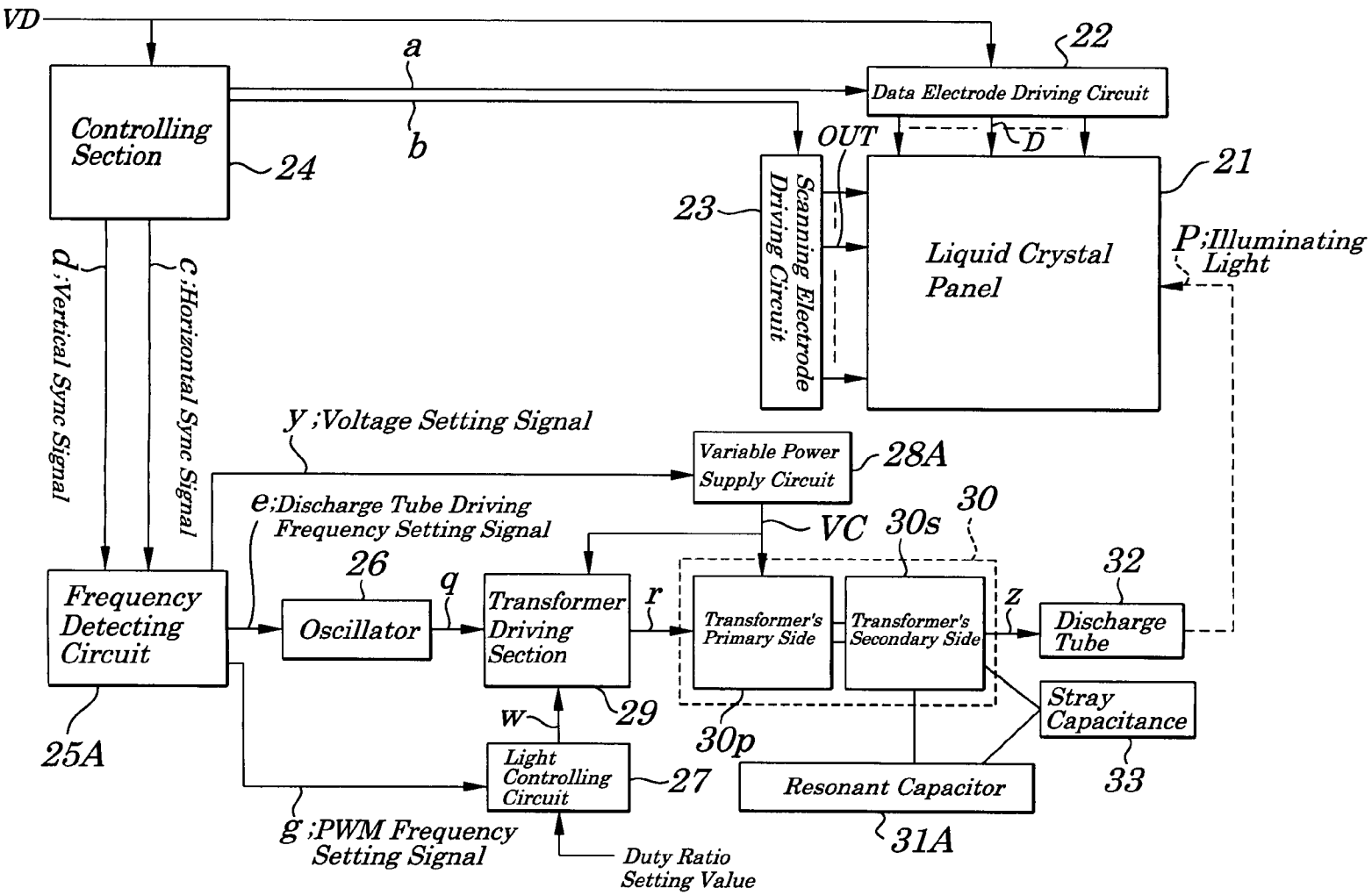
FIG. 7 is a schematic block diagram showing electrical configurations of a liquid crystal display device according to a second embodiment of the present invention.

FIG. 7 is a schematic block diagram showing electrical configurations of a liquid crystal display device according to a second embodiment of the present invention. In FIG. 7, same reference numbers are assigned to components having same functions as those in the first embodiment shown in FIG. 1. In the liquid crystal display device of the second embodiment, as shown in FIG. 7, instead of a frequency detecting circuit 25, a power supply circuit 28, a resonant capacitor 31, a frequency detecting circuit 25A, a variable power supply circuit 28A, and a resonant capacitor 31A all having configurations different from those in the first embodiment are provided. The variable power supply circuit 28A applies a power source "VC" to a transformer driving section 29 and a primary side 30*p* of a transformer 30 in response to a voltage setting signal "y" fed from the frequency detecting circuit 25A. The resonant capacitor 31A is a capacitor whose capacitance is set at a specified value. The frequency detecting circuit 25A has, instead of the function of producing a capacitance setting signal "u", a function of producing the voltage setting signal "y" and transmitting the voltage setting signal "y" to the variable power supply circuit 28A. In the second embodiment in particular, the frequency detecting circuit 25A sets a resonant frequency of a resonant circuit (not labeled) at a value in the vicinity of a frequency of a driving pulse voltage "z" by setting the power source "VC" to be fed from the variable power supply circuit 28A to the primary side 30*p* of the transformer 30 in a manner to be variable according to the voltage setting signal "y".

For example, the frequency detecting circuit 25A sets a frequency of the driving pulse voltage "z" at a value in the vicinity of "M+½" times ("M": a positive integer) of a frequency of a horizontal sync signal "c" and a pulse frequency for a PWM light control exercised by a light controlling circuit 27 at a value in the vicinity of a positive integral multiple or "positive integer+½" times of a vertical sync signal "d" and a resonant frequency at a value in the vicinity of the driving pulse voltage "z" by making a voltage to be fed to the resonant circuit (not shown) variable to calibrate capacitance value of a stray capacitance 33. Moreover, the frequency detecting circuit 25A sets a frequency of the driving pulse voltage "z" at a value in the vicinity of a positive integral multiple of the horizontal sync signal "c" and the pulse frequency for the above PWM light control exercised by the light controlling circuit 27 at a value in the vicinity of a positive integral multiple or "positive integer+½" times of the vertical sync signal "d" and the above resonant frequency at a value in the vicinity of the driving pulse voltage "z" by making a voltage to be applied to the resonant circuit (not shown) variable to calibrate capacitance value of the stray capacitance 33. Other operations are the same as those shown in FIG. 1.

Figure 8:
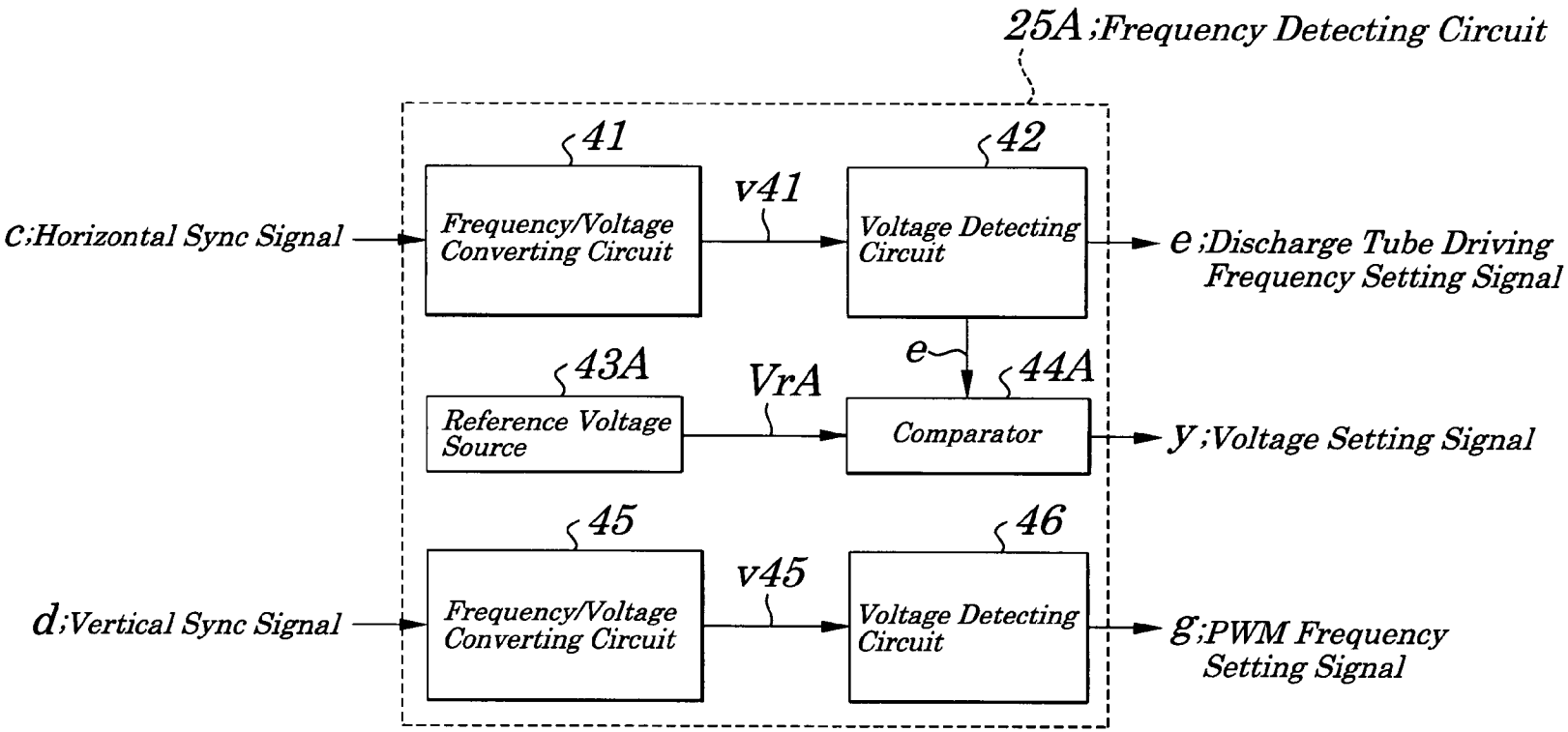
FIG. 8 is a schematic block diagram showing electrical configurations of a frequency detecting circuit employed in the liquid crystal display device of FIG. 7.

FIG. 8 is a schematic block diagram showing electrical configurations of a frequency detecting circuit 25A employed in the liquid crystal display device of FIG. 7. In FIG. 8, same reference numbers are assigned to components having same functions as those in the first embodiment shown in FIG. 2.

In the frequency detecting circuit 25A of the second embodiment, as shown in FIG. 8, instead of a reference voltage source 43 and a comparator 44, a reference voltage source 43A and a comparator 44A all having configurations different from those in the first embodiment are provided. The reference voltage source 43A produces a source voltage "VrA" used to generate the voltage setting signal "y". The comparator 44A compares to check whether a discharge tube driving frequency setting signal "e" is larger or smaller than a reference voltage "VrA" and produces the voltage setting signal "y". Other operations are the same as those shown in FIG. 2.

Figure 9:
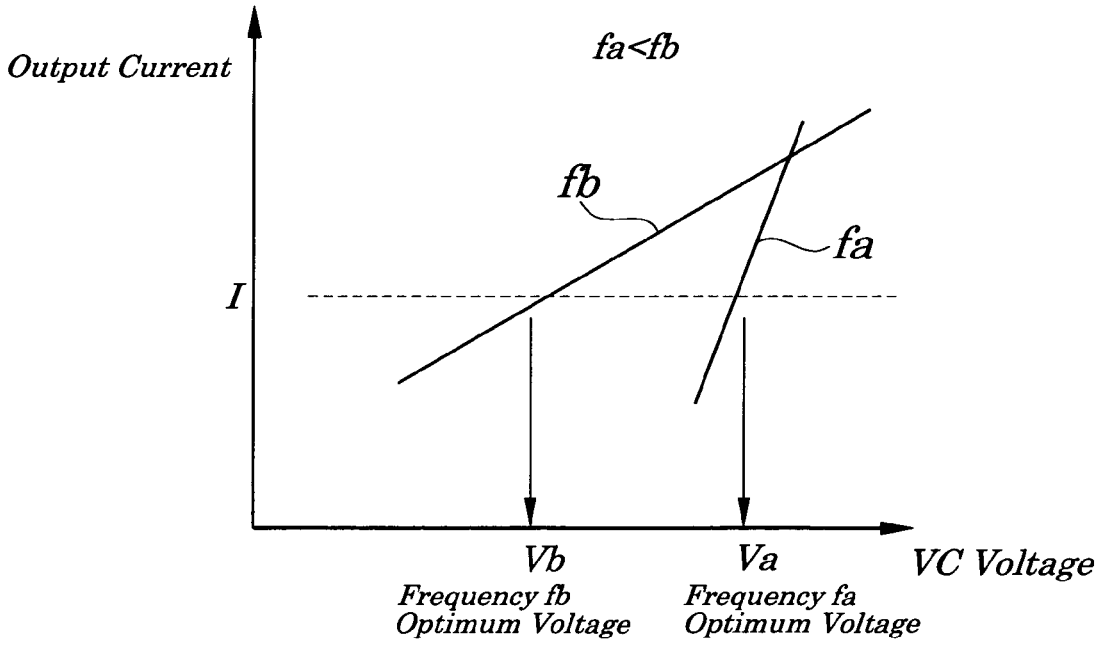
FIG. 9 is a diagram showing a relation among a frequency of a driving pulse voltage, a source voltage, and a current to be output from a secondary side of a transformer.
Figure 10:
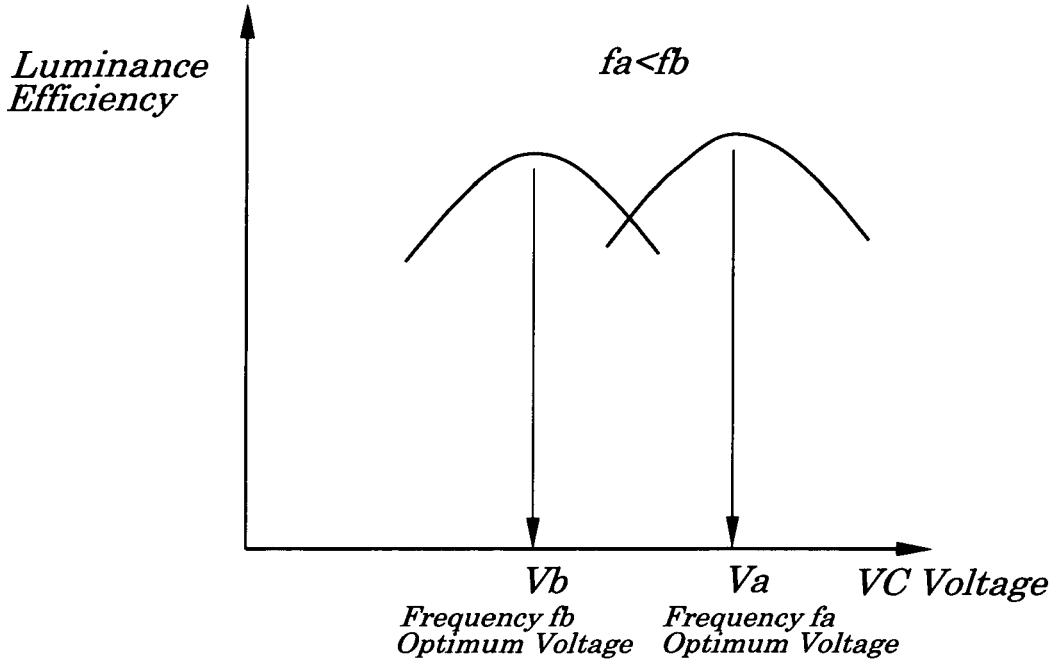
FIG. 10 is a diagram showing a relation between a source voltage and luminance efficiency of a discharge tube.
Figure 11:
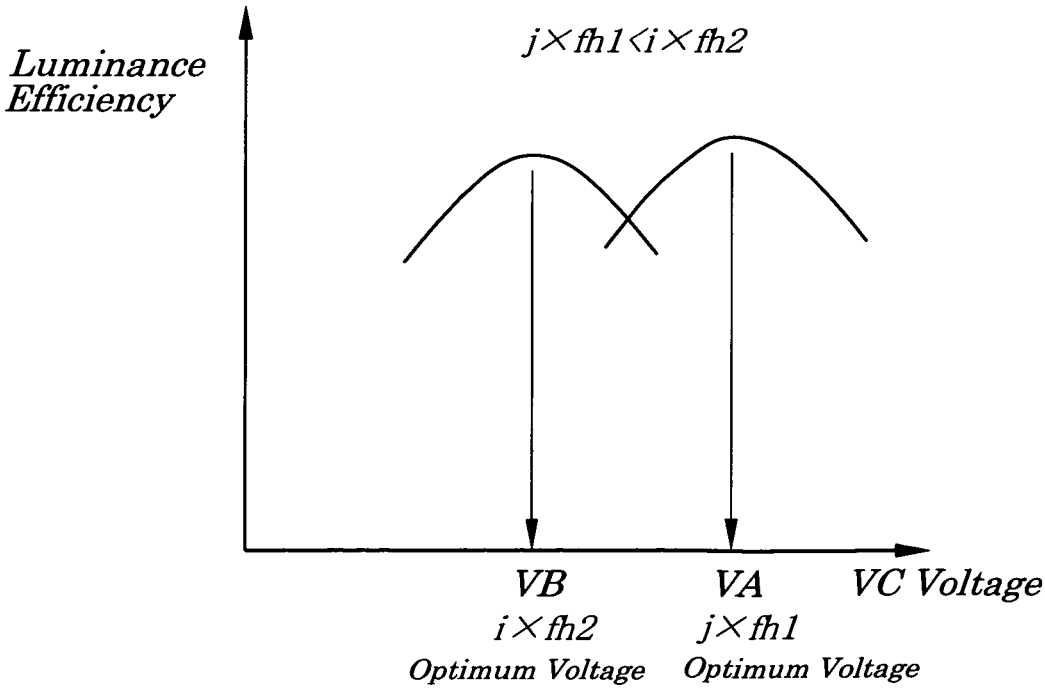
FIG. 11 is a diagram showing a relation between the source voltage and luminance efficiency of the discharge tube.

FIG. 9 is a diagram showing a relation among the frequency of the driving pulse voltage "z", the power source "VC", and a current to be output from a secondary side 30*s* of the transformer 30. FIGS. 10 and 11 are diagrams each showing a relation between voltage of the power source "VC" and luminance efficiency of a discharge tube 32.

A method for driving a light source employed in the liquid crystal display device of the second embodiment of the present invention is described by referring to FIGS. 9, 10, and 11. The method for driving the light source of the embodiment differs from that employed in the first embodiment in the following points. That is, when a frequency of the horizontal sync signal "c" is "fh1" and a frequency of the vertical sync signal "d" is "fv1", a frequency "fa" of the driving pulse voltage "z" is set at a value in the vicinity of "(n+½)×fh1" by the frequency detecting circuit 25A and the discharge tube 32 is lit and, at this time, the voltage setting signal "y" is fed from the frequency detecting circuit 25A to the variable power supply circuit 28A and the power source "VC" based on the voltage setting signal "y" is output from the variable power supply circuit 28A.

Here, when the frequency "fh1" of the horizontal sync signal "c" is changed to be "fh2" and the frequency "fv1" of the vertical sync signal "d" is changed to be "fv2" by switching of specification of a liquid crystal panel 21 from XGA to, for example, SXGA, the frequency of the driving pulse voltage "z" is set at "fb". At this time, as shown in FIG. 9, a current being output from the secondary side 30*s* of the transformer 30, versus a voltage of the power source "VC", differs depending on whether the frequency of the driving pulse voltage "z" is high (in the case of the frequency "fb") or low (in the case of the frequency "fa") and, therefore, an amount of plasma occurring inside the discharge tube 32 changes and capacitance value of the stray capacitance 33 changes depending on the voltage of the power source "VC". The resonant frequency "f" is given by a following equation:

$$f=1/[2\pi\{L(C+Cf)\}^{1/2}]$$

where L denotes an inductance component on the secondary side 30*s* of the transformer 30, C denotes capacitance of the resonant capacitor 31A and Cf denotes capacitance value of the stray capacitance 33. Due to changes in the capacitance value Cf of the stray capacitance 33, the resonant frequency "f" changes by voltage of the power source "VC".

Therefore, as shown in FIG. 10, in the relation between the voltage of the power source "VC" and luminance efficiency (luminance of the discharge tube 32 divided by the voltage of the power source "VC"), when a frequency of the driving pulse voltage "z" is "fa", the power source "VC" of an optimum voltage "Va" having a highest luminance efficiency is output from the variable power supply circuit 28A. The voltage "Va", as shown in FIG. 9, is a voltage at which an output current from the secondary side 30*s* of the transformer 30 becomes a specified current value I. Moreover, when a frequency of the driving pulse voltage "z" becomes "fb", the power source "VC" of a voltage "Vb" having highest luminance efficiency is output from the variable power supply circuit 28A. The voltage "Vb", as shown in FIG. 9, is a voltage at which an output current on the secondary side 30*s* becomes the above current value I.

Furthermore, when a frequency of the driving pulse voltage "z" is set at a j (positive integer) times or at a value (for example, about j×fh1±1 kHz") in its vicinity of the frequency "fh1" of the horizontal sync signal "c", the relation between the voltage of the power source "VC" and luminance efficiency (luminance of the discharge tube 32 divided by the source voltage "VC") of the discharge tube 32 becomes what is shown in FIG. 11, in which, when the frequency of the driving pulse voltage "z" is "j×fh1", a voltage "VA" having highest luminance efficiency is output from the variable power supply circuit 28A. The voltage "VA" is a voltage at which an output current on the secondary side 30*s* becomes a specified current value I (as in the case shown in FIG. 9). Furthermore, the frequency "fh1" of the horizontal sync signal "c" is changed to be "fh2" and the frequency "fv1" of the vertical sync signal "d" is changed to be "fv2", and in a case in which a frequency of the driving pulse voltage "z" is set at an i (positive integer) times or in its vicinity (for example, about i×fh2±1 kHz") of the frequency "fh2" of the horizontal sync signal "c", when the frequency of the driving pulse voltage "z" is "i×fh2", a voltage "VB" having highest luminance efficiency is output from the variable power supply circuit 28A. The voltage "VB", as same as in the case shown in FIG. 9, is a voltage at which an output current on the secondary side 30*s* becomes the above current value I.

As describe above, in the second embodiment, the frequency detecting circuit 25A sets a frequency of the driving pulse voltage "z" at a value in the vicinity of "positive integer+½" of a frequency of the horizontal sync signal "c" and a pulse frequency of the pulse voltage of the PWM light control at a value in the vicinity of a positive integral multiple or "positive integer+½" times of the frequency of the vertical sync signal "d" and a resonant frequency at a value in the vicinity of a frequency of the driving pulse voltage "z" by adjusting (calibrating) capacitance value of the stray capacitance 33, even when changes in the frequencies of the horizontal sync signal "c" and vertical sync signal "d" occur, visual seeing of flicker and ripples caused by interference between the driving pulse voltage "z" of the discharge tube 32 and the horizontal sync signal "c" on the liquid crystal panel 21 is suppressed and degradation in the efficiency of the discharge tube 32 is prevented. Also, when the frequency detecting circuit 25A set a frequency of the driving pulse voltage "z" at a value in the vicinity of a positive integral multiple of the frequency of the horizontal sync signal "c", the same advantage can be obtained.

Figure 12:
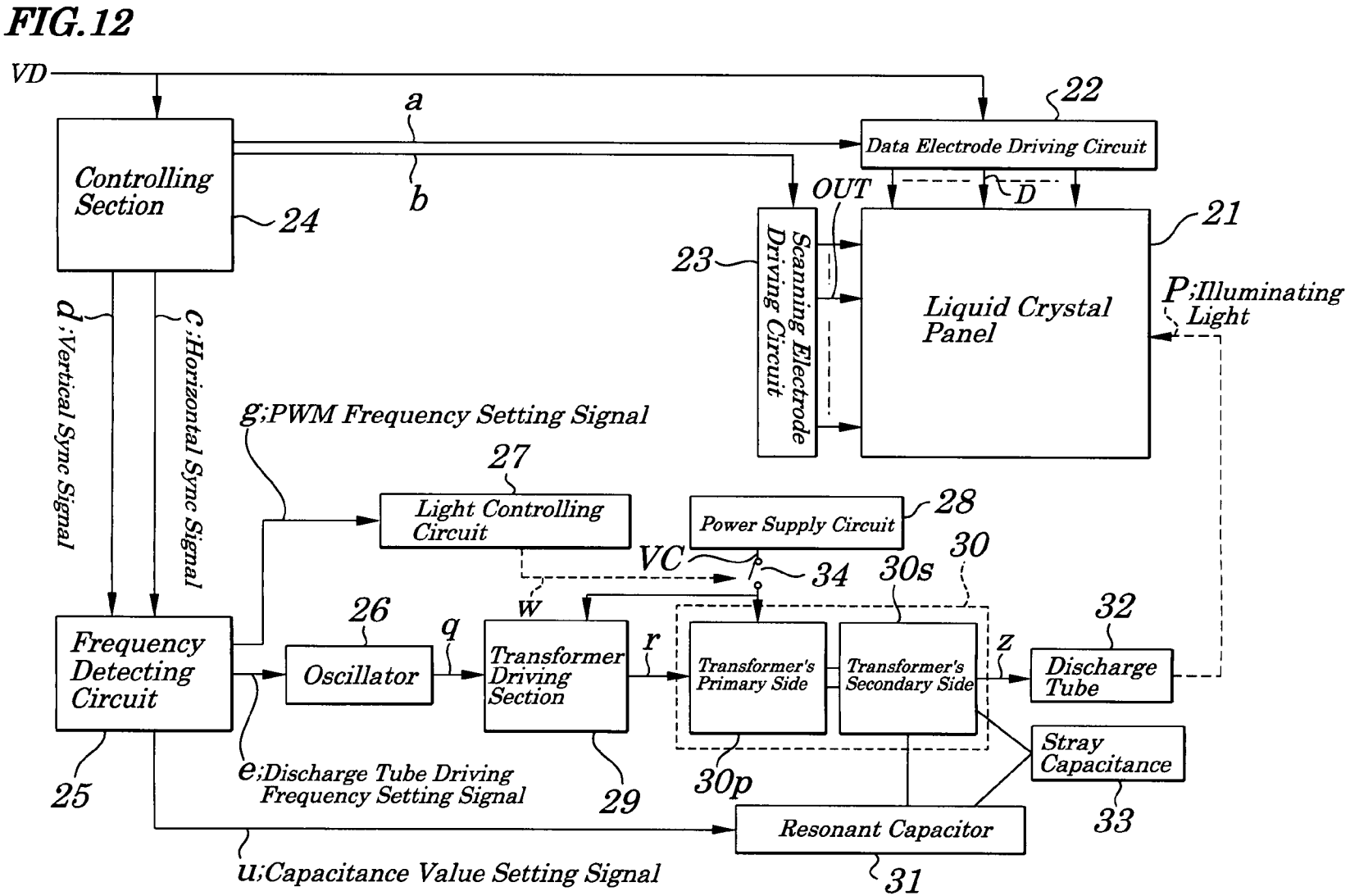
FIG. 12 is a schematic block diagram showing another example of electrical configurations of the liquid crystal display device.
Figure 13:
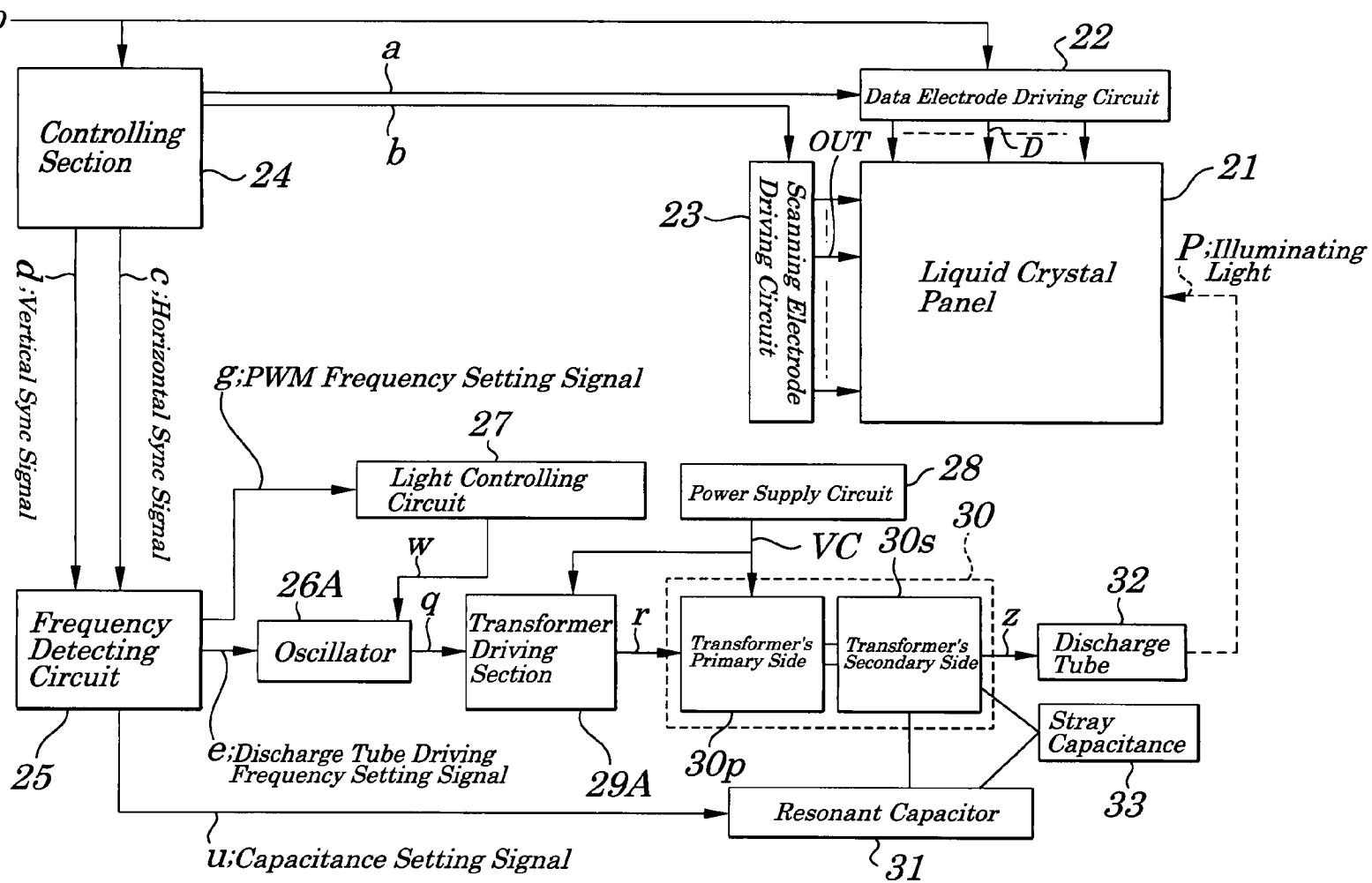
FIG. 13 is a schematic block diagram showing another example of electrical configurations of the liquid crystal display device.

It is apparent that the present invention is not limited to the above embodiments but may be changed and modified without departing from the scope and spirit of the invention. For example, the liquid crystal display device of the embodiment, as shown in FIG. 12, may be so configured that a switch 34 is provided between a power supply circuit 28 and a node between a transformer driving section 29 and a transformer 30, and PWM light control is exercised by ON/OFF control of the switch 34 by using a control signal "w" fed from light controlling circuit 27. Moreover, the liquid crystal display device of the embodiment, as shown in FIG. 13, may be so configured that an oscillator 26A, instead of oscillator 26 shown in FIG. 1, is provided and operations of the oscillator 26A is controlled by the control signal "w" fed from the light controlling circuit 27.

Figure 14:
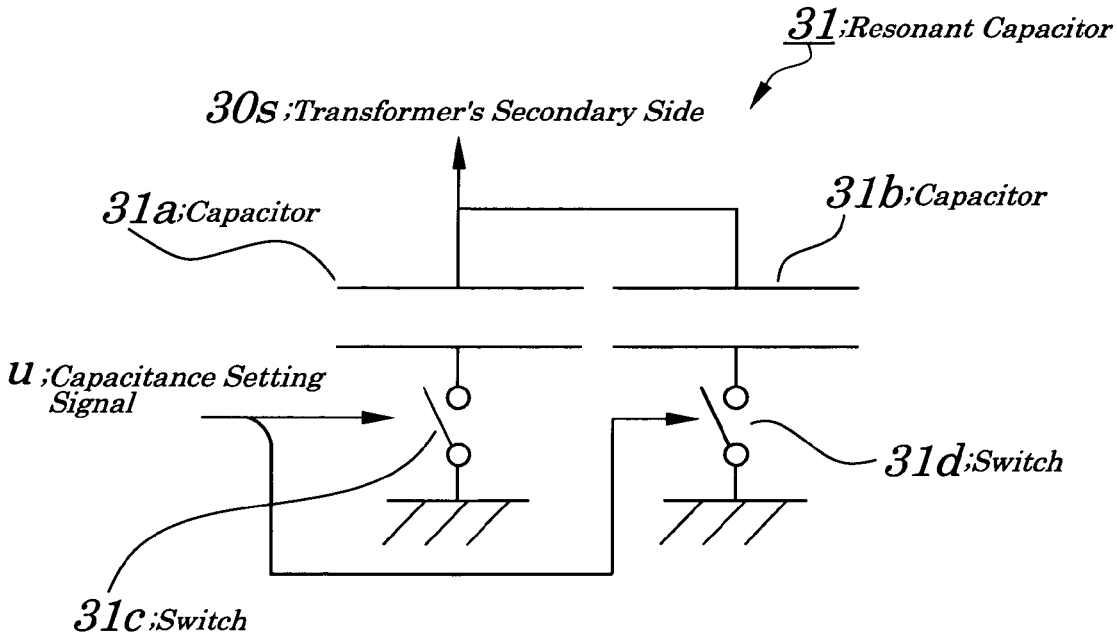
FIG. 14 is a schematic block diagram showing another example of electrical configurations of a resonant capacitor.
Figure 15:
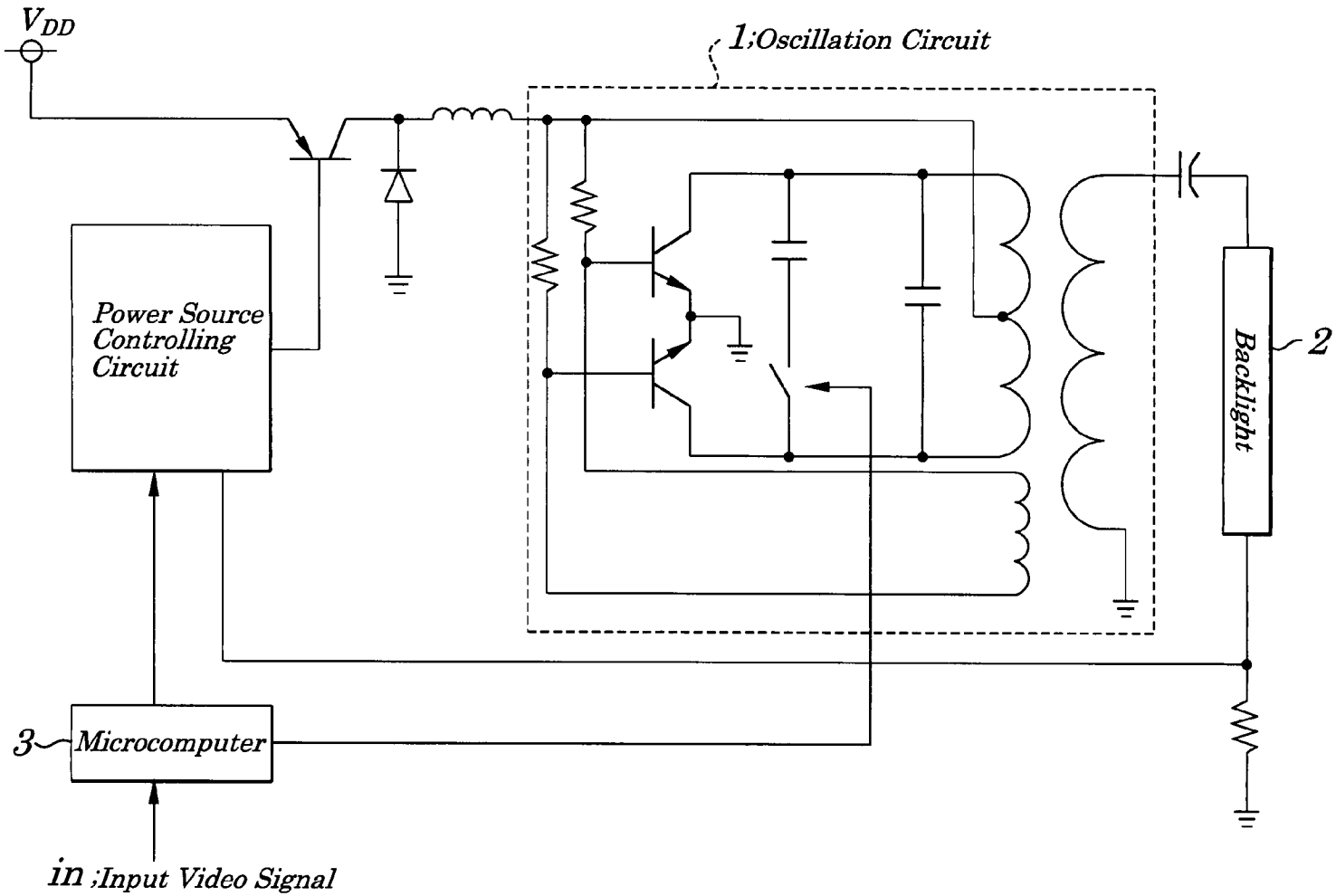
FIG. 15 (PRIOR ART)
FIG. 15 is a diagram illustrating main components of a backlight driving circuit used in a conventional liquid crystal display device disclosed in Japanese Patent Application Laid-open No. 2002-8887.
Figure 16:
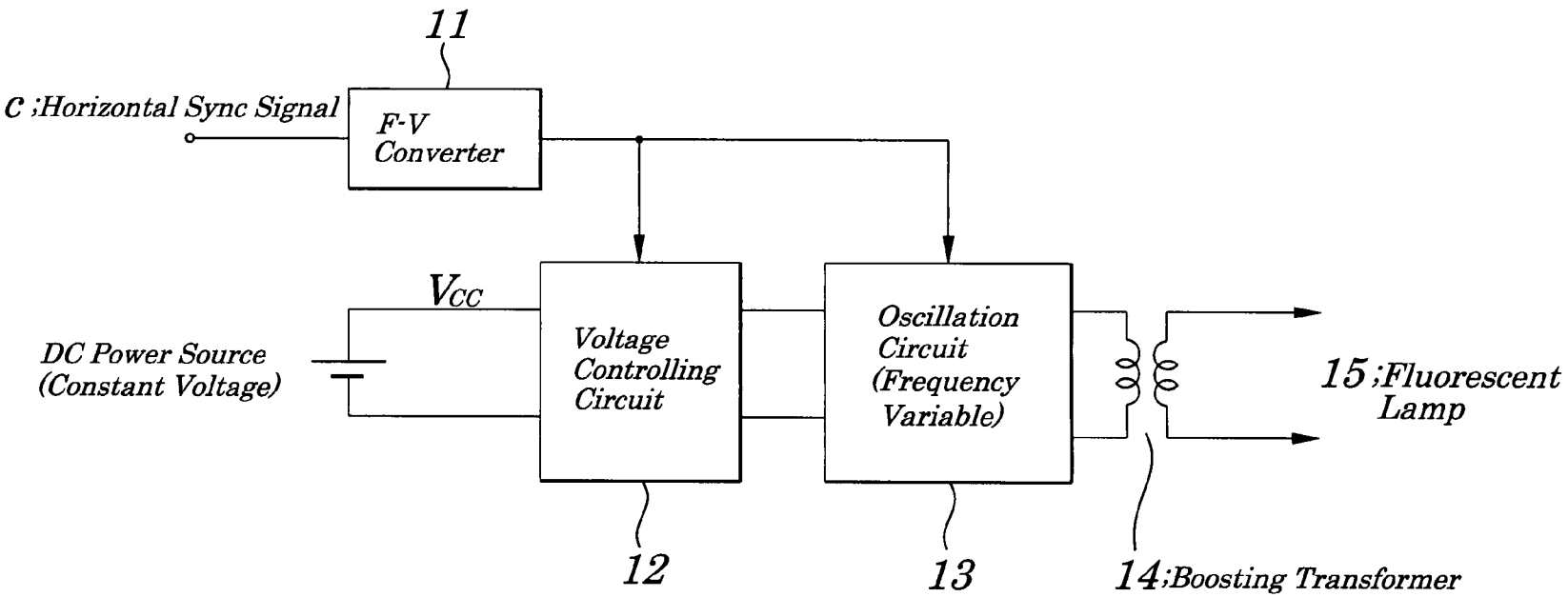
FIG.16 (PRIOR ART)
FIG. 16 is a diagram showing main components of another conventional liquid crystal display device provided with a backlight disclosed in Japanese Patent Application Laid-open No. Hei 05-113766.

Furthermore, the resonant capacitor 31 of FIG. 1 may have configurations shown in FIG. 14, in addition to those shown in FIG. 4. As shown in FIG. 14, the resonant capacitor 31 includes capacitors 31*a* and 31*b*, switches 31*c* and 31*d*. The switches 31*c* and 31*d* are controlled ON/OFF according to a capacitance setting signal "u". The capacitors 31*a* and 31*b* may be used in parallel, alternatively, either of the capacitor 31*a* or 31*b* may be used. Moreover, the resonant capacitor 31 may have not only the configurations shown in FIG. 4 or FIG. 14 but also configurations made up a plurality of circuits shown in FIG. 4 or FIG. 14. Furthermore, the resonant capacitor 31 may have configurations obtained by combining the above components.

The present invention can be applied to all kinds of the liquid crystal display panel having such a function, as a multisync function, of operating in a case when frequencies of a vertical sync signal and horizontal sync signal contained in a video input signal are changed, whenever necessary, such as a multisync function. Even when frequencies of the vertical sync signal and horizontal sync signal are changed, no ripples are visually recognized and the discharge tube can be effectively lit.

What is claimed is:

1. A liquid crystal display device comprising:

a liquid crystal panel to display an image according to a video input signal;

a light source to illuminate said liquid crystal panel when a driving pulse voltage is applied; and a light source driving circuit having a resonant circuit containing stray capacitance that said light source has and a resonant capacitor to exercise PWM (pulse width modulation) light control by applying said driving pulse voltage whose frequency is set at a value in a vicinity of a resonant frequency of said resonant circuit intermittently to said light source at a pulse frequency and at a duty ratio set respectively for the PWM light control; and wherein said light source driving circuit comprises a driving pulse setting unit to detect a frequency of a horizontal sync signal and a frequency of a vertical sync signal contained in the video input signal, to set/change the frequency of the driving pulse voltage and the resonant frequency of said resonant circuit in a manner to correspond to a change in the frequency of the horizontal sync signal, and to set/change the pulse frequency for the PWM control in a manner to correspond to a change in the frequency of the vertical sync signal.

2. The liquid crystal display device according to claim 1, wherein said driving pulse setting unit sets the frequency of the driving pulse voltage at a value at which flicker and fringes caused by interference between the horizontal sync signal and the driving pulse voltage are not visually recognized on said liquid crystal panel and sets the resonant frequency at a value in a vicinity of the frequency of the driving pulse voltage, and sets the pulse frequency for the PWM light control at a value at which the flicker and the fringes caused by interference between the vertical sync signal and a frequency pulse for the PWM light control are not visually recognized on said liquid crystal panel.

3. The liquid crystal display device according to claim 2, wherein said driving pulse setting unit sets the frequency of the driving pulse voltage at a value in a vicinity of "M+½" times ("M": a positive integer) of the frequency of the horizontal sync signal, the pulse frequency for the PWM light control at a value in a vicinity of "N" times or "N+½" times ("N": a positive integer) of the frequency of the vertical sync signal, and the resonant frequency at a value in a vicinity of the frequency of the driving pulse voltage by adjusting capacitance value of the resonant capacitor.

4. The liquid crystal display device according to claim 2, wherein said driving pulse setting unit sets the frequency of the driving pulse voltage at a value in a vicinity of "M" times ("M": a positive integer) of the frequency of the horizontal sync signal, the pulse frequency for the PWM light control at a value in a vicinity of "N" times or "N+½" times ("N": a positive integer) of the frequency of the vertical sync signal, and the resonant frequency at a value in a vicinity of the frequency of the driving pulse voltage by adjusting capacitance value of the resonant capacitor.

5. The liquid crystal display device according to claim 2, wherein said driving pulse setting unit sets the frequency of the driving pulse voltage at a value in a vicinity of "M+½" times ("M": a positive integer) of the frequency of the horizontal sync signal, the pulse frequency for the PWM light control at a value in a vicinity of "N" times or "N+½" times ("N": a positive integer) of the frequency of the vertical sync signal, and the resonant frequency at a value in a vicinity of the frequency of the driving pulse voltage by adjusting capacitance value of said stray capacitance.

6. The liquid crystal display device according to claim 2, wherein said driving pulse setting unit sets the frequency of the driving pulse voltage at a value in a vicinity of "M" times ("M": a positive integer) of the frequency of the horizontal sync signal and the pulse frequency for the PWM light control at a value in a vicinity of "N" times or "N+½" times ("N": a positive integer) of the frequency of the vertical sync signal and the resonant frequency at a value in a vicinity of the frequency of the driving pulse voltage by adjusting capacitance value of said stray capacitance.

7. A light source driving circuit being used for a liquid crystal display device having a liquid crystal panel to display an image according to a video input signal and a light source to illuminate said liquid crystal panel when a driving pulse voltage is applied, and comprising a resonant circuit containing stray capacitance that said light source has and a resonant capacitor to exercise PWM (pulse width modulation) light control by applying said driving pulse voltage whose frequency is set at a value in a vicinity of a resonant frequency of said resonant circuit intermittently to said light source at a pulse frequency and at a duty ratio set respectively for the PWM light control, the light source driving circuit further comprising:

a driving pulse setting unit to detect a frequency of a horizontal sync signal and a frequency of a vertical sync signal contained in the video input signal, to set/change the frequency of the driving pulse voltage and the resonant frequency of said resonant circuit in a manner to correspond to a change in the frequency of the horizontal sync signal, and to set/change the pulse frequency for the PWM control in a manner to correspond to a change in the frequency of the vertical sync signal.

8. A light source driving method being used for a liquid crystal display device having a liquid crystal panel to display an image according to a video input signal and a light source to illuminate said liquid crystal panel when a driving pulse voltage is applied, and comprising: using a resonant circuit containing stray capacitance that said light source has and a resonant capacitor, and exercising PWM (pulse width modulation) light control by applying the driving pulse voltage whose frequency is set at a value in a vicinity of a resonant frequency of said resonant circuit intermittently to said light source at a pulse frequency and at a duty ratio set respectively for the PWM light control, the light source driving method further comprising:

detecting a frequency of a horizontal sync signal and a frequency of a vertical sync signal contained in the video input signal, setting/changing the frequency of the driving pulse voltage and the resonant frequency of said resonant circuit in a manner to correspond to a change in the frequency of the horizontal sync signal, and setting/changing the pulse frequency for the PWM control in a manner to correspond to a change in the frequency of the vertical sync signal.

9. A liquid crystal display device comprising:

a liquid crystal panel to display an image according to a video input signal;

a light source to illuminate said liquid crystal panel when a driving pulse voltage is applied; and a light source driving circuit having a resonant circuit containing stray capacitance that said light source has and a resonant capacitor to exercise PWM (pulse width modulation) light control by applying said driving pulse voltage whose frequency is set at a value in a vicinity of a resonant frequency of said resonant circuit intermittently to said light source at a pulse frequency and at a duty ratio set respectively for the PWM light control; and wherein said light source driving circuit comprises a driving pulse setting means to detect a frequency of a horizontal sync signal and a frequency of a vertical sync signal contained in the video input signal, to set/change the frequency of the driving pulse voltage and the resonant frequency of said resonant circuit in a manner to correspond to a change in the frequency of the horizontal sync signal, and to set/change the pulse frequency for the PWM control in a manner to correspond to a change in the frequency of the vertical sync signal.

10. The liquid crystal display device according to claim 9, wherein said driving pulse setting means sets the frequency of the driving pulse voltage at a value at which flicker and fringes caused by interference between the horizontal sync signal and the driving pulse voltage are not visually recognized on said liquid crystal panel and sets the resonant frequency at a value in a vicinity of the frequency of the driving pulse voltage, and sets the pulse frequency for the PWM light control at a value at which the flicker and the fringes caused by interference between the vertical sync signal and a frequency pulse for the PWM light control are not visually recognized on said liquid crystal panel.

11. The liquid crystal display device according to claim 10, wherein said driving pulse setting means sets the frequency of the driving pulse voltage at a value in a vicinity of "M+½" times ("M": a positive integer) of the frequency of the horizontal sync signal, the pulse frequency for the PWM light control at a value in a vicinity of "N" times or "N+½" times ("N": a positive integer) of the frequency of the vertical sync signal, and the resonant frequency at a value in a vicinity of the frequency of the driving pulse voltage by adjusting capacitance value of the resonant capacitor.

12. The liquid crystal display device according to claim 10, wherein said driving pulse setting means sets the frequency of the driving pulse voltage at a value in a vicinity of "M" times ("M": a positive integer) of the frequency of the horizontal sync signal, the pulse frequency for the PWM light control at a value in a vicinity of "N" times or "N+½" times ("N": a positive integer) of the frequency of the vertical sync signal, and the resonant frequency at a value in a vicinity of the frequency of the driving pulse voltage by adjusting capacitance value of the resonant capacitor.

13. The liquid crystal display device according to claim 10, wherein said driving pulse setting means sets the frequency of the driving pulse voltage at a value in a vicinity of "M+½" times ("M": a positive integer) of the frequency of the horizontal sync signal, the pulse frequency for the PWM light control at a value in a vicinity of "N" times or "N+½" times ("N": a positive integer) of the frequency of the vertical sync signal, and the resonant frequency at a value in a vicinity of the frequency of the driving pulse voltage by adjusting capacitance value of said stray capacitance.

14. The liquid crystal display device according to claim 10, wherein said driving pulse setting means sets the frequency of the driving pulse voltage at a value in a vicinity of "M" times ("M": a positive integer) of the frequency of the horizontal sync signal and the pulse frequency for the PWM light control at a value in a vicinity of "N" times or "N+½" times ("N": a positive integer) of the frequency of the vertical sync signal and the resonant frequency at a value in a vicinity of the frequency of the driving pulse voltage by adjusting capacitance value of said stray capacitance.

* * * * *